US011662684B2

(12) United States Patent
Pettingill et al.

(10) Patent No.: US 11,662,684 B2
(45) Date of Patent: May 30, 2023

(54) CARTRIDGE COUPLABLE TO PRINTING APPARATUS AND HAVING MOVABLE DRIVER COUPLER

(71) Applicant: HEWLETT-PACKARD DEVELOPMENT COMPANY, L.P., Spring, TX (US)

(72) Inventors: Justin Pettingill, Boise, ID (US); Jeffrey H. Luke, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/594,498

(22) PCT Filed: Dec. 9, 2019

(86) PCT No.: PCT/US2019/065305
§ 371 (c)(1),
(2) Date: Oct. 19, 2021

(87) PCT Pub. No.: WO2021/118527
PCT Pub. Date: Jun. 17, 2021

(65) Prior Publication Data

US 2022/0179356 A1 Jun. 9, 2022

(51) Int. Cl.
*G03G 21/16* (2006.01)
*B41J 29/38* (2006.01)
*G03G 21/18* (2006.01)

(52) U.S. Cl.
CPC ..... *G03G 21/1647* (2013.01); *B41J 29/38* (2013.01); *G03G 21/1661* (2013.01); *G03G 21/186* (2013.01)

(58) Field of Classification Search
CPC ..... G03G 21/1647; G03G 21/1661; G03G 21/1857; G03G 21/186; G03G 2221/1657; B41J 2/1752; B41J 29/38
See application file for complete search history.

(56) References Cited

U.S. PATENT DOCUMENTS

| | | | |
|---|---|---|---|
| 5,561,499 | A | 10/1996 | Setoriyama |
| 6,789,876 | B2 | 9/2004 | Barclay et al. |
| 6,801,736 | B2 | 10/2004 | Senda |
| 7,082,274 | B2 | 7/2006 | Saitoh et al. |
| 7,231,164 | B2 | 6/2007 | Harada et al. |

(Continued)

FOREIGN PATENT DOCUMENTS

| | | | |
|---|---|---|---|
| AU | 2014200252 | A1 | 7/2014 |
| CN | 1685290 | A | 10/2005 |

(Continued)

OTHER PUBLICATIONS

Machine translation of JP 2013-160918 A, Tenjiku et al., published on Aug. 19, 2013 (Year: 2013).*

*Primary Examiner* — Sophia S Chen
(74) *Attorney, Agent, or Firm* — Foley & Lardner LLP

(57) ABSTRACT

A cartridge couplable to a printing apparatus may include a driver coupler movable in a first direction toward an engaging position to engage with a power driver of the printing apparatus to drive the cartridge and a power transfer member including a power transfer part to transfer power moving the driver coupler in the first direction toward the engaging position, as the power transfer part moves in a second direction different from the first direction.

13 Claims, 13 Drawing Sheets

(56) References Cited

U.S. PATENT DOCUMENTS

| | | | | |
|---|---|---|---|---|
| 7,769,324 | B2 | 8/2010 | Mitamura et al. | |
| 8,182,389 | B2 | 5/2012 | Koizumi | |
| 2005/0214023 | A1* | 9/2005 | Foster | G03G 21/1647 399/119 |
| 2009/0123181 | A1* | 5/2009 | Ito | G03G 21/1647 399/167 |
| 2017/0157826 | A1 | 6/2017 | Hishiki | |

FOREIGN PATENT DOCUMENTS

| | | | |
|---|---|---|---|
| JP | 2013160918 | A | 8/2013 |
| KR | 20060012820 | A | 2/2006 |
| KR | 20160086367 | A | 7/2016 |

* cited by examiner

CARTRIDGE COUPLABLE TO PRINTING APPARATUS AND HAVING MOVABLE DRIVER COUPLER

BACKGROUND

A printing apparatus performs printing. A printing apparatus may be coupled with a cartridge such as a printing cartridge that contains and supplies toner to be used by the printing apparatus to perform printing. When the toner contained in the container is exhausted, the printing cartridge may be decoupled and removed from the printing apparatus, and a new printing cartridge may be inserted or coupled to the printing apparatus.

DETAILED DESCRIPTION

In this disclosure, when the specification states that one constituent element is "connected to" another constituent element, it includes a case in which the two constituent elements are connected to each other with another constituent element intervened therebetween as well as a case in which the two constituent elements are directly connected to each other. As used herein, the term "and/or" includes any and all combinations of one or more of the associated listed items. Expressions such as "at least one of," when preceding a list of elements, modify the entire list of elements and do not modify the individual elements of the list.

Further, the expression "printing apparatus" as used herein includes an apparatus that processes printing data generated at a terminal such as a computer communicating through a wired connection or wirelessly, which may be a computer for personal and/or business use, a remote server communicating data across a network or the internet, and/or a wireless mobile device such as a smartphone or tablet, to perform printing. Examples of the printing apparatus may include particulate-based printing apparatuses.

As an example of a printing apparatus, electrophotographic printing apparatuses are used to produce hardcopy documents from electronic data. Toner-based printing apparatuses are an example. In an electrophotographic printing apparatus, a pattern of electric charges is formed corresponding to the image to be printed. Charged toner is then attracted to the image pattern to develop the image. The image can then be transferred to a print medium, such as a sheet of paper. The toner can then be securely attached to the print medium and delivered as a hardcopy document.

Figure 1A:
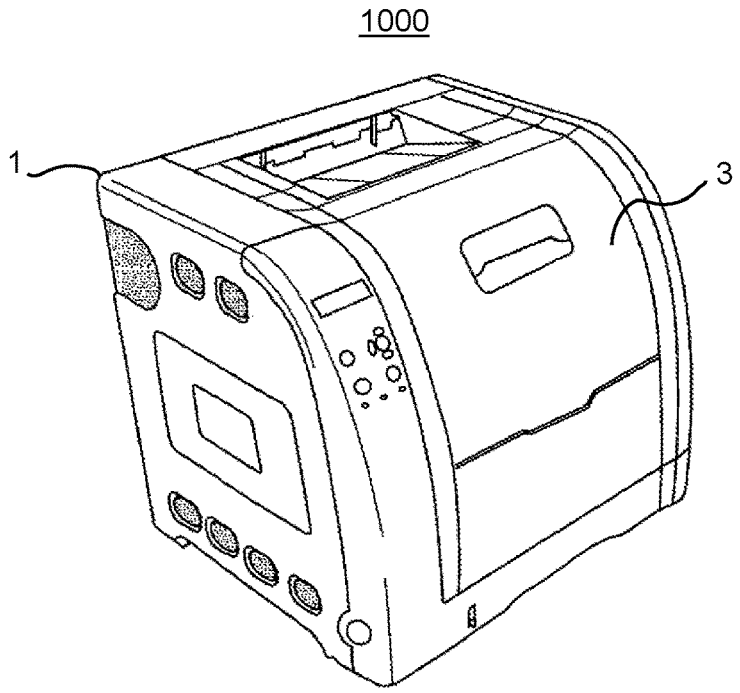
FIGS. 1A and 1B are diagrams of an example of a printing apparatus.
Figure 1B:
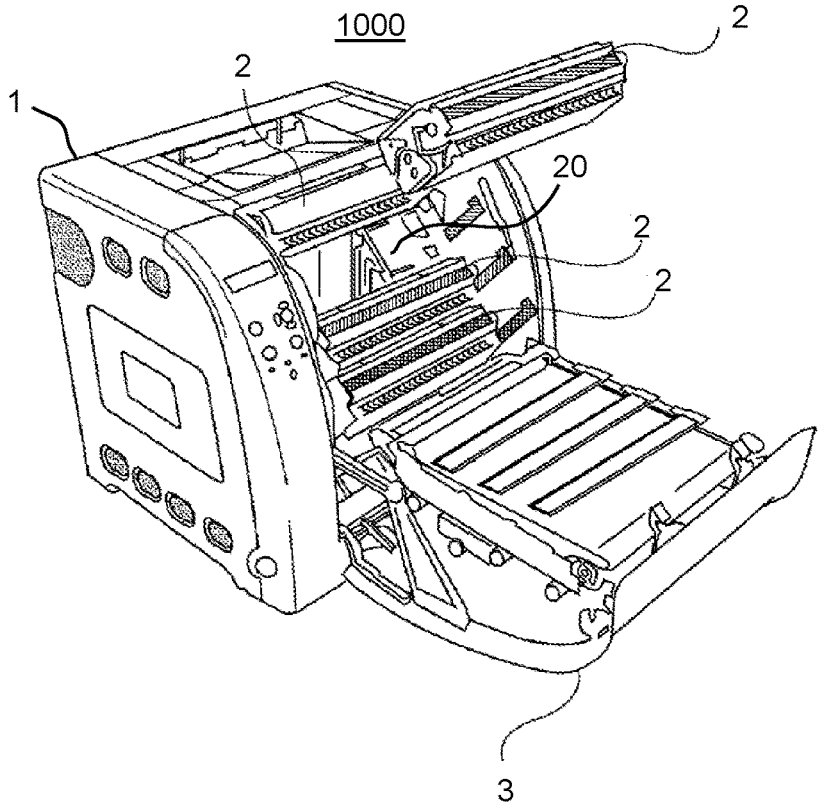

According to an example, FIG. 1A is a perspective view of the exterior of a printing apparatus 1000. According to an example, FIG. 1B is a perspective view of the exterior of a printing apparatus 1000 with a door 3 being open to expose a cartridge receiving part 20 of the printing apparatus 1000 to receive cartridge 2, such as a printing cartridge 2. According to an example, the printing apparatus 1000 may include a body 1 without a printing cartridge 2 or a body 1 and a printing cartridge 2 that is attachable to/detachable from the body 1, for example, to and from the cartridge receiving part 20. According to an example, more than one cartridge 2, such as cartridges containing toners of different colors, may be couplable to the plurality of cartridge receiving parts 20. As illustrated in FIGS. 1A and 1B, a door 3 may be provided in the body 1. The door 3 opens or closes an opening of the body 1 and may cover a portion of the body 1. For example, the door 3 may cover the cartridge receiving part 20 to which a cartridge 2 such as a toner cartridge 2 may be coupled to or inserted into. While the door 3 opening and closing a front portion of the body 1 is illustrated in FIG. 1A, different arrangements of the door 3 may be implemented. For example, a door 3 opening and closing a portion of the body 1, such as a side portion or a front portion of the body 1, may be included as needed. The cartridge 2 may be coupled to or removed from the body 1 through an opening by the door 3. According to an example, the printing apparatus 1000 may include a plurality of cartridge receiving parts 20, to receive cartridges for different operations, functions, or purposes. For example, the plurality of cartridge receiving parts 20 may be arranged to receive a plurality of toner cartridges respectively including toners of different colors.

An example of a printing apparatus may include some or all of the features described in this disclosure.

In a toner-based printing apparatus, for example, uniform coverage of charges is initially formed on a photo-conductor drum. The light such as a laser and LED is scanned over the surface of the cylindrical photosensitive drum according to the image to be printed. Where the light illuminates the surface of the photo-conductor drum, a partially discharged area is formed. These charged and discharged areas together compose a pattern corresponding to the image to be printed.

Charged toner is then applied to the photosensitive drum. The charged toner is then driven by electric fields in the latent electrostatic image to the discharged areas on the drum, thereby developing the image to be printed. The toner image can then be transferred to a print medium, such as a sheet of paper, to produce the desired hardcopy document.

Figure 2:
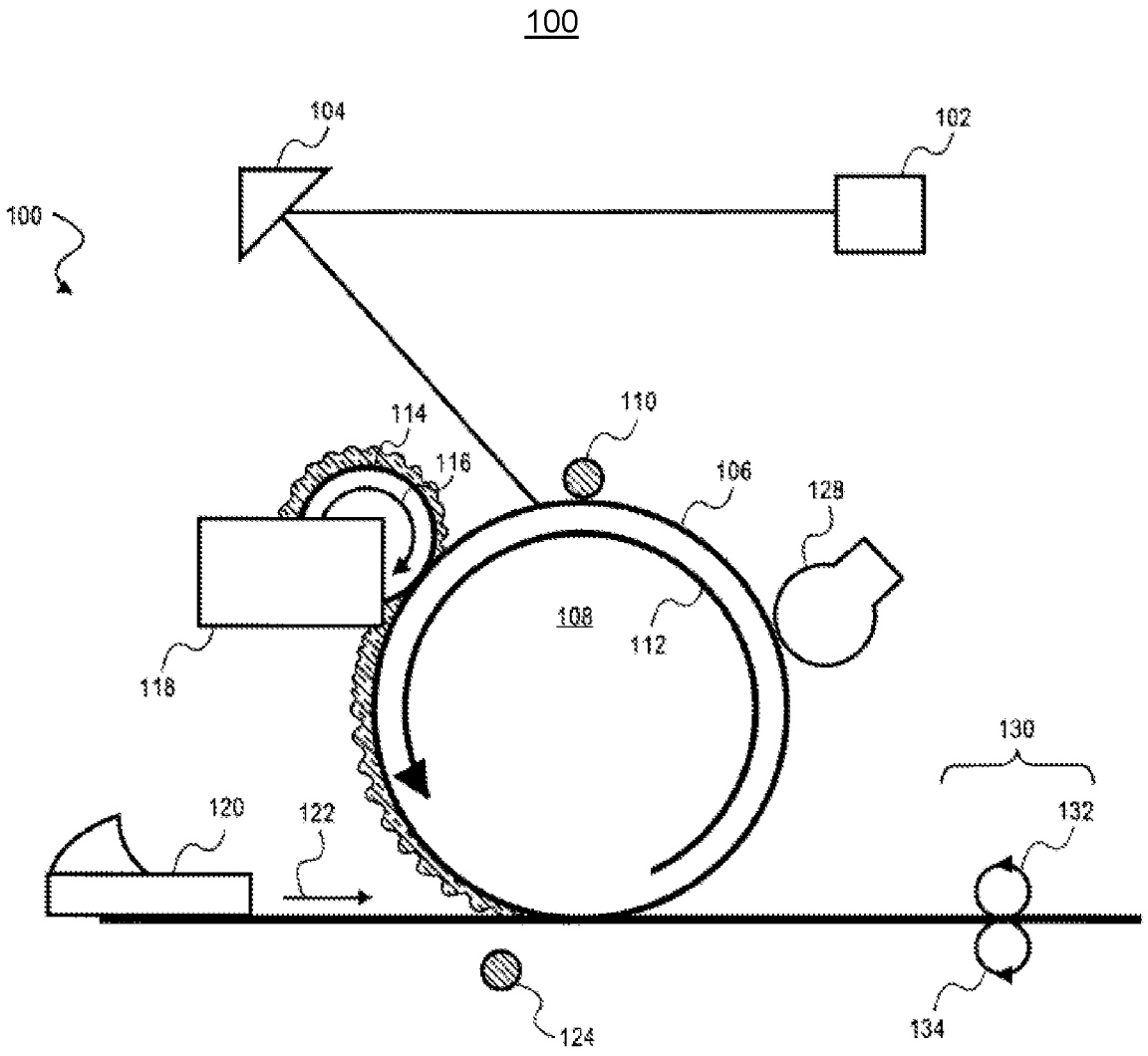
FIG. 2 is a diagram of the manner by which electrophotographic printing can be accomplished, according to an example.

According to an example, FIG. 2 is a diagram of the manner by which an electrophotographic printing can be accomplished, according to an example.

According to an example, at least a part of this electrophotographic mechanism may include in a printing apparatus 1000. The electrophotographic printing mechanism may include a photosensitive drum 108 such as photoconductor drum 108, which is made from highly photoconductive material that is discharged by light photons. The photosensitive drum 108 may also be referred to as a photoreceptor drum 108, a photoconductor 108, an optical photoconductor 108, or an organic photoconductor 108. Initially, the photosensitive drum 108 is given a total positive charge via a charge roller 110. The charge roller 110 is in contact with the drum 108 during image formation on the media 120 for precise alignment of the image to be formed on the media 120. At other times, during non-use, the charge roller 110 may be separated from the photosensitive drum 108, as will be described.

As the photosensitive drum 108 revolves, the printing mechanism shines a light beam such as a laser beam or a LED light beam emanating from the light beam source 102, and reflected by the reflector 104, onto the surface 106 of the photosensitive drum 108 to discharge certain points in accordance with an image. In this way, the light beam draws, or scans, the image to be printed as a pattern of electrical charges, which can be referred to as an electrostatic image. The photosensitive drum 108 may rotate counter-clockwise, as indicated by the arrow 112. After the pattern as the electrostatic image has been set, the printing mechanism coats the drum 108 with toner, which is a fine powder. For example, the toner also may have a positive charge, so the toner clings to the discharged areas of the drum 108, but not to the positively charged background.

The toner is dispensed by a developer roller 114 that rotates clockwise, as indicated by the arrow 116, against the photosensitive drum 108, after having rotated through the toner hopper 118 to pick up toner. The developer roller 114 is also in contact with the photosensitive drum 108 during image formation on the media 120 for alignment of the image to be formed on the media 120. At other times, during non-use, the developer roller 114 may be separated from the photosensitive drum 108. With the powder pattern affixed, the drum 108 rolls over a sheet of media 120, which moves in the direction indicated by the arrow 122. Before the media 120 rolls under the drum 108, it is given a negative charge by the transfer roller 124. This charge is stronger than the charge of the electrostatic image, so the media 120 pulls the powder away from the drum 108. Since it is moving at the same speed as the drum 108, the media 120 picks up the image pattern exactly.

The printing mechanism 100 finally passes the media 120 through the fuser 130, which can be a pair of heated rollers 132 and 134 that move in the opposite direction. As the media 120 passes through these heated rollers 132 and 134, the loose toner powder melts, fusing with the fibers in the media 120. The fuser 130 rolls the media 120 to an output tray, providing a printed page. After depositing the toner on the media 120, the drum 108 passes the discharge lamp. 128, which is a bright light. This exposes the entire photoreceptor surface of the drum 108, erasing its electrical image, so that the process is ready to be repeated.

One or more components of the electrophotographic-printing mechanism as illustrated in FIG. 2 may be encased within a removable cartridge 2 that can be replaced. A variety of cartridge structures may be included in the cartridge 2. For example, the removable cartridge 2 can be a toner cartridge 2 containing toner and replaceable when the toner supply of the toner cartridge 2 has been depleted. For example, the removable cartridge 2 may include a drum 10. According to an example, the drum 10 may be the photosensitive drum 108, the developer roller 114, and the charge roller 110, or any roller usable to perform a function for the printing apparatus 1000 or the cartridge 2. According to an example, the toner hopper 118 or a corresponding component thereto, the photosensitive drum 108, the developer roller 114, and the charge roller 110 may all be encased within a removable toner cartridge 2. As such, when the toner supply present in the toner hopper 118 or the corresponding component thereto has been depleted, the toner cartridge 2 is replaced with a new, fresh toner cartridge 2 to continue forming images on media. According to an example, the cartridge 2 may be a printing cartridge 2 that includes a developing portion in which the photosensitive drum 108 and the developing roller 114 are mounted, a waste container receiving waste toner removed from the photosensitive drum 108, and a toner containing portion connected to the developing portion and containing toner.

According to an example, a variety of cartridge 2 structures for a printing apparatus may be implemented. For example, FIGS. 3A and 3B are schematic perspective views of a cartridge 2 couplable to a cartridge receiving part 20 of the printing apparatus illustrated in FIG. 1B, according to an example.

Figure 3A:
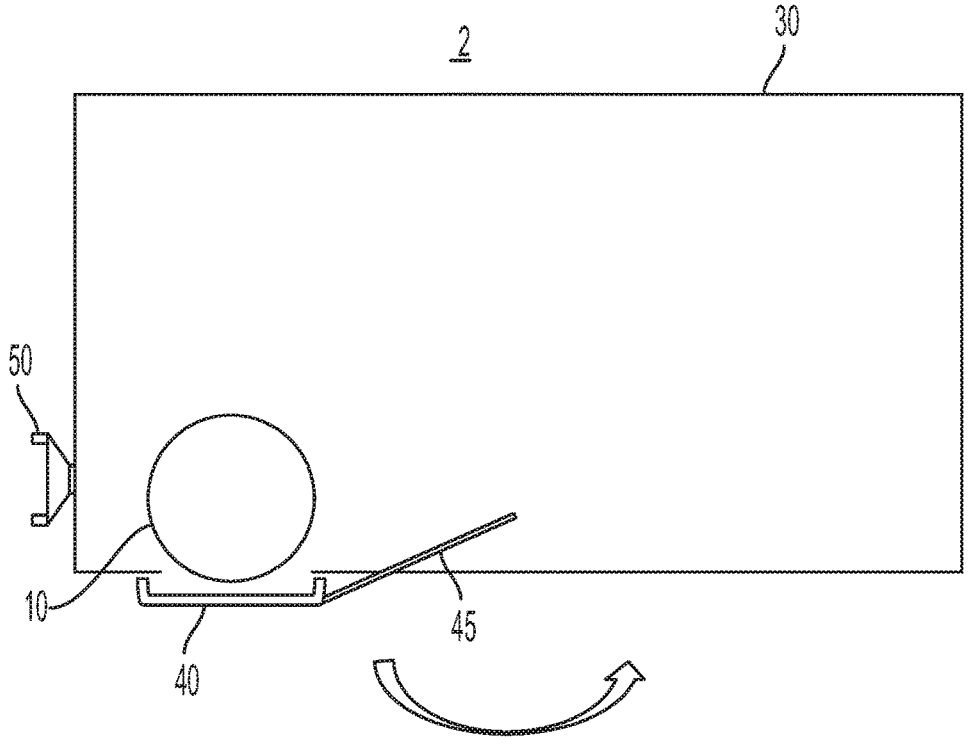
FIGS. 3A and 3B are structural diagrams of a cartridge couplable to the printing apparatus illustrated in FIG. 1B according to an example.

Referring FIG. 3A, the cartridge 2 may include a drum 10, which could be the photosensitive drum 108, the developer roller 114, the charge roller 110, or any roller usable to perform a function for the printing apparatus 1000 or the cartridge 2, or any combination of rollers thereof. For example, the cartridge 2 may include the photosensitive drum 108. The drum 10 may be rotated by receiving power, such as a rotational force form of power, from a power supply 400 of the printing apparatus 1000 through a driver coupling mechanism 50 when the cartridge 2 is mounted on the body 1 of the printing apparatus as shown in FIG. 1B. The power to be received may be in a variety of forms, including different forms of mechanical power and electrical power.

According to an example, the cartridge 2 may include a housing 30 to house cartridge structures. For example, the housing 30 may include the drum 10. The housing 30 may have an opening through which a portion of an outer circumference of the drum 10 is exposed outside the housing 30. According to an example, the cartridge 2 may include a cartridge cover 40 to cover at least a portion of the opening of the housing 30 and, hence, cover at least a portion of the outer circumference of the drum 10 exposed outside the housing 30.

Figure 3B:
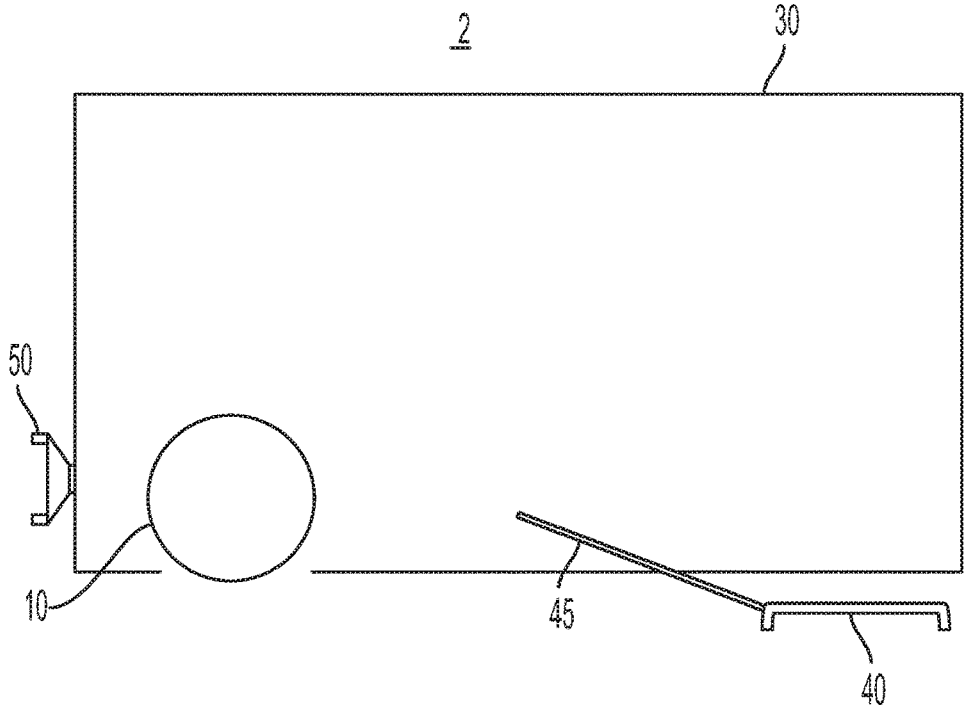

Referring FIGS. 3A and 3B, the cartridge cover 40 may be movable to open at least a portion of the opening of the cartridge 2, such that at least a portion of the drum 10 is exposed outside the housing 30. The cartridge cover 40 may be movable to close at least a portion of the opening of the cartridge 2, such that the exposed portion of the drum 10 is covered by the cartridge cover 40. The cartridge cover 40 may move to an open position to open at least a portion of the opening of the cartridge 2, as the cartridge 2 is coupled to the cartridge receiving part 20, for example, by being inserted into the cartridge receiving part 20. As the cartridge 2 is moved to be decoupled from the cartridge receiving part 20, for example, by being pulled out from the cartridge receiving part 20, the cartridge cover 40 may move to close at least a portion of the opening of the cartridge 2. The cartridge 2 may include a cover lever 45 coupled to the cartridge cover 40, to move the cartridge cover 40 to open and close at least a portion of the opening of the cartridge 2. For example, the cover lever 45 may be attached through the external surface of the housing 30. The cover lever 45 may be rotated around the center of rotation to move the cartridge cover 40, which may be the portion of the housing 30 the cover lever 45 is attached to.

According to an example, a variety of driver coupling mechanism 50 to transfer power to drive the cartridge 2 may be implemented. For example, FIG. 4 is a diagram representing arrangements of the driver coupling mechanism 50 according to an example.

Figure 4:
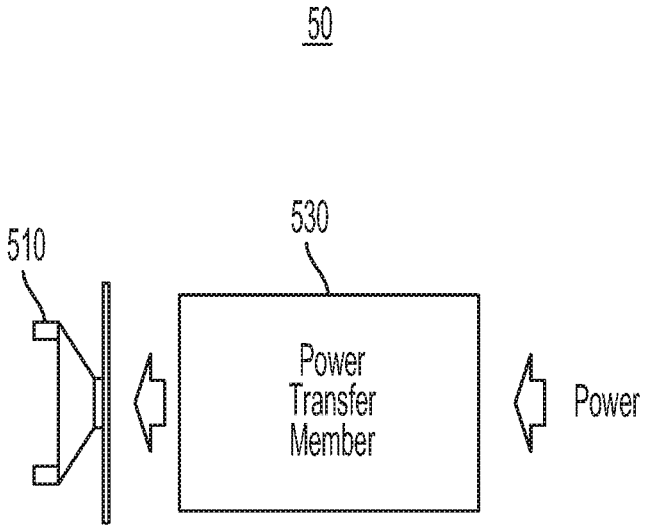
FIG. 4 is a diagram representing arrangements of a driver coupling mechanism according to an example.

According to an example, referring FIG. 4, the driver coupling mechanism 50 may include a driver coupler 510 to be coupled to, contact, and/or engaged with a power driver 410 of the printing apparatus 1000 to receive power, to drive the cartridge 2 and a power transfer member 530 to receive and/or transfer power to move the driver coupler 510. According to an example, power received and/or transferred by the power transfer member 530 to move the driver coupler 510 may or may not be from the printing apparatus 1000, such as a component or a part of the printing apparatus 1000.

According to an example, a cartridge 2 couplable to a printing apparatus 1000 may include, as the driver coupling mechanism 50, a driver coupler 510 movable to a first position where the driver coupler 510 is engaged with a power driver 410 of the printing apparatus 1000 to receive power to operate the cartridge 2 and a second position where the driver coupler 510 is disengaged from the power driver 410. According to an example, the cartridge 2 may include a power transfer member 530 to receive power to move the driver coupler 510 from the second position to the first position. For example, the power transfer member 530 may be a torque receiver to receive torque to move the driver coupler 510 from the second position to the first position. According to an example, the power transfer member 530 may receive and/or transfer power from another moving part of the cartridge 2 or the printing apparatus 1000. According to an example, the power transfer member 530 may receive and/or transfer power of moving another moving part of the cartridge 2 or the printing apparatus 1000. For example, the power transfer member 530 may receive and/or transfer power or torque of moving the cartridge cover 40. According to an example, the power transfer member 530 may receive and/or transfer power from the printing apparatus 1000, such as a component or a part of the printing apparatus 1000.

According to an example, a printing apparatus 1000 may include a cartridge receiving part 20 to which a cartridge 2 couplable to. The cartridge 2 may include, as the driver coupling mechanism 50, a driver coupler 510 movable to a first position where the driver coupler 510 is engaged with a power driver 410 of the printing apparatus 1000 to receive power to operate the cartridge 2 a second position where the driver coupler 510 is disengaged from the power driver 410. According to an example, the cartridge 2 may include a power transfer member 530 to receive power to move the driver coupler 510 from the second position to the first position. For example, the power transfer member 530 may be a torque receiver to receive torque to move the driver coupler 510 from the second position to the first position. According to an example, the power transfer member 530 may receive and/or transfer power from another moving part of the cartridge 2 or the printing apparatus 1000. According to an example, the power transfer member 530 may receive and/or transfer power of moving another moving part of the cartridge 2 or the printing apparatus 1000. For example, the power transfer member 530 may receive and/or transfer power or torque of moving the cartridge cover 40.

According to an example, a cartridge 2 couplable to a printing apparatus 1000 may include a driver coupler 510 movable to a first position where the driver coupler 510 is engaged with a power driver 410 of the printing apparatus 1000 to receive first power from/through the power driver 410 and a second position where the driver coupler 510 is disengaged from the power driver 410. According to an example, the cartridge 2 may include a power transfer member 530 to receive second power other than the first power to move the driver coupler 510 from the second position to the first position.

According to an example, a cartridge 2 couplable to a printing apparatus 1000 may include a driver coupler 510 movable to a first position where the driver coupler 510 is engaged with a power driver 410 of the printing apparatus 1000 to receive first power from the power driver 410 and a second position where the driver coupler 510 is disengaged from the power driver 410. According to an example, the cartridge 2 may include a power transfer member 530 to receive power to move the driver coupler 510 from the second position to the first position while the driver coupler 510 moves.

According to an example, a cartridge 2 couplable to a printing apparatus 1000 may include a driver coupler 510 movable to a first position where the driver coupler 510 is engaged with a power driver 410 of the printing apparatus to receive first power from the power driver 410 and a second position where the driver coupler 510 is disengaged from the power driver 410. According to an example, the cartridge 2 may include a power transfer member 530 or its part movable in a first direction to move the driver coupler 510, while the driver coupler 510 moves from the second position to the first position in a second direction different from the first direction.

According to an example, a cartridge 2 couplable to a printing apparatus 1000 may include a driver coupler 510 movable to a first position where the driver coupler 510 is engaged with a power driver 410 of the printing apparatus to receive first power from the power driver 410 and a second position where the driver coupler 510 is disengaged from the power driver 410. According to an example, the cartridge 2 may include a power transfer member 530 to receive power to move in a first direction to move the driver coupler 510, while the driver coupler 510 moves from the second position to the first position in a second direction different from the first direction.

According to an example, a cartridge 2 couplable to a printing apparatus 1000 may include a driver coupler 510 movable to a first position where the driver coupler 510 is engaged with a power driver 410 of the printing apparatus to receive first power from the power driver 410 and a second position where the driver coupler 510 is disengaged from the power driver 410. According to an example, the cartridge 2 may include a power transfer member 530 including a power transfer part 531 to receive power to move in a first direction to move the driver coupler 510, while the driver coupler 510 moves from the second position to the first position in a second direction different from the first direction. The power transfer part 531 may receive the power to rotate in the first direction to move the driver coupler 510 in the second direction.

According to an example, a cartridge 2 couplable to a printing apparatus 1000 may include a driver coupler 510 movable in an engaging direction toward an engaging position to be engaged with a power driver of the printing apparatus to drive the cartridge 2 and a power transfer member 530 to change a direction of force to the engaging direction, to move the driver coupler 510 in the engaging direction toward the engaging position.

According to an example, a cartridge 2 couplable to a printing apparatus 1000 may include a driver coupler 510 movable in a first direction toward an engaging position to engage with a power driver 410 of the printing apparatus 1000 to drive the cartridge 2, and a power transfer member 530 including a power transfer part 531 to cause the driver coupler 510 to move in the first direction toward the engaging position, as the power transfer part 531 moves in a second direction different from the first direction.

According to an example, a cartridge 2 couplable to a printing apparatus 1000 may include a driver coupler 510 movable in a first direction toward an engaging position to engage with a power driver of the printing apparatus to drive the cartridge 2. The cartridge 2 may include a power transfer member 530 including a power transfer part 531 to transfer power moving the driver coupler 510 in the first direction toward the engaging position, as the power transfer part 531 moves in a second direction different from the first direction. According to an example, the power transfer part 531 may be to rotate in the second direction by receiving torque.

According to an example, a printing apparatus 1000 may include a cartridge receiving part 20 to which a cartridge 2 according to an example is couplable to.

According to an example, a variety of mechanical structures can be implemented for the driver coupling mechanism 50 as a power transfer mechanism 50 including the driver coupler 510 and the power transfer member 530. For example, as a driver coupler 510 (also can be as a drive coupling member 510, a force receiving member 510, a coupler 510, or a mechanical coupling member or interface 510), a variety of structures can be implemented, such as a dongle gear-based coupling or mating structure, to connect a power source 410, a power driver 410, a driving mechanism 410, an engine 410 of the printing apparatus 1000. For example, as the power transfer member 530, a variety of structures to transfer power can be implemented, such as a mechanical structure to receive rotational force or convert rotational movements to a movement of the driver coupler 510, a crank or piston system based structure, a rack or a rack having an extended length. According to an example, the power transfer member 530 may include a part that moves in a direction different from the direction the driver coupler 510 is to move.

Figure 5:
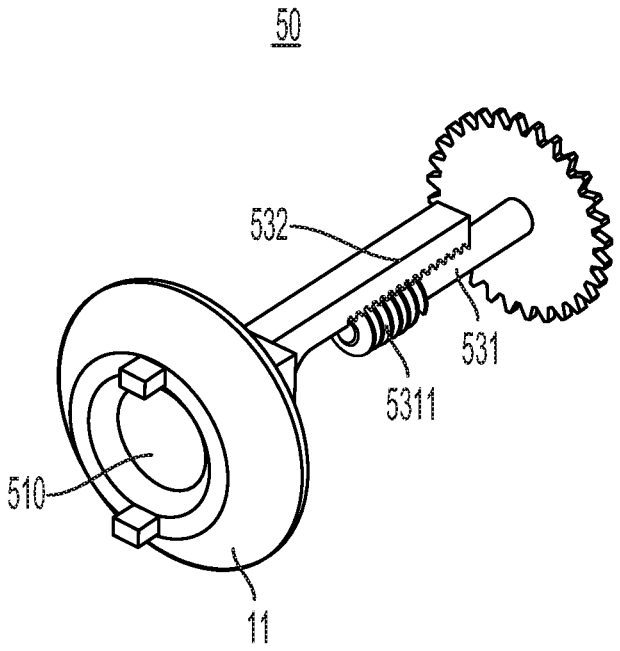
FIG. 5 illustrates a perspective view of the driver coupling mechanism according to an example.

For example, FIG. 5 illustrates a perspective view of the driver coupling mechanism 50 according to an example.

Referring FIG. 5, the driver coupling mechanism 50 may include a driver coupler 510 or a driver coupling assembly 510. The driver coupling mechanism 50 may include a cartridge power interface 11 or a cartridge drive interface 11. The cartridge power interface 11 or a cartridge drive interface 11 may receive power from the printing apparatus 1000 to drive the cartridge 2. For example, the cartridge power interface 11 or the cartridge drive interface 11 may receive power and transfer power to a gear and/or a roller in the cartridge 2. For example, the cartridge power interface 11 or the cartridge drive interface 11 may receive power and transfer the power to the drum 10, such as a photosensitive drum. According to an example, the cartridge power interface 11 or the cartridge drive interface 11 may receive power through the driver coupler 510. For example, the cartridge power interface 11 or a cartridge drive interface 11 may receive power from the driver coupler 510 engaged with the power driver 410. A variety of cartridge power interface 11 structures may be implemented, such as a gear, a disc and a mechanical connector. According to an example, the driver coupling mechanism 50 may include a power transfer member 530 including a first power transfer part 531 and a second power transfer part 532. According to an example, the first power transfer part 531 and the second power transfer part 532 may not be driven by the power being received and transferred by the cartridge power interface 11. For example, while the driver coupler 510 engages with the power driver 410 and the power driver 410 transfers power such as torque or rotational power, and/or while the cartridge power interface 11 transfers power such as torque or rotational power, the first power transfer part 531 and the second power transfer part 532 may not receive, driven, or rotated by the power being received through the power driver 410, the driver coupler 410 or the cartridge power interface 11. According to an example, the first power transfer part 531 may be a worm gear-based structure 531. For example, the first power transfer part 531 may include a rotatable worm gear 5311. The second power transfer part 532 may include a rack 532 or gear rack-based structure 532. According to an example, power in the form of rotational power may be delivered to and received by the worm gear assembly 530 as shown in FIG. 5. As the worm gear 5311 rotates, the direction of the movement may be translated as or converted to a forward or backward movement of the rack 532. Based on the movement of the rack 532, the driver coupler 510 or the driver coupling assembly 510 may be connected or coupled to the rack 532, and move along with the rack 532 to move, for example, in a forward or backward direction. In other words, power received by the worm gear assembly 530 in the form of a rotational movement is converted to a different direction by the worm gear-rack connection, to move the driver coupler 510 according to the different direction.

Figure 6A:
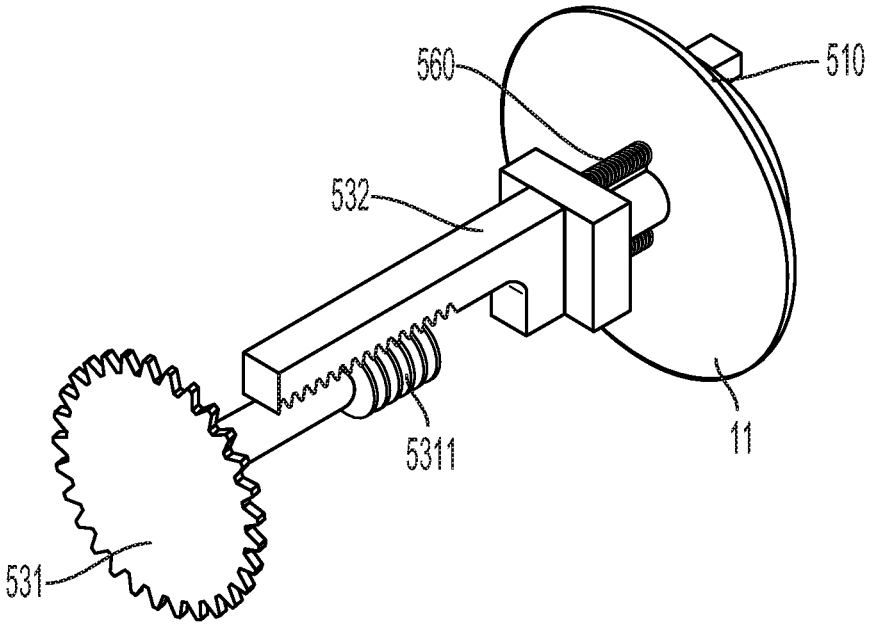
FIGS. 6A and 6B illustrate perspective views of the driver coupling mechanism according to an example.
Figure 6B:
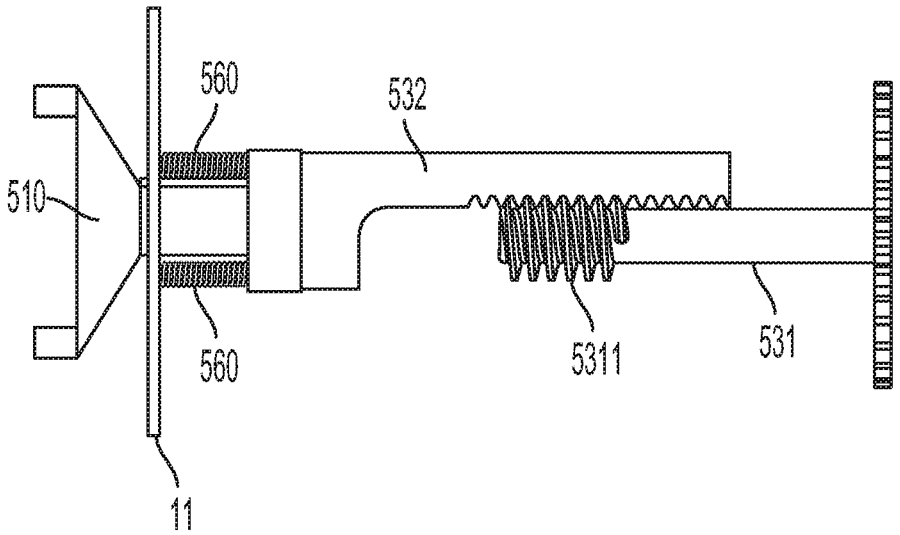

According to an example, FIGS. 6A and 6B illustrate perspective views of the driver coupling mechanism 50 according to an example.

Referring FIGS. 6A and 6B, the driver coupling mechanism 50 may include an elastic member 560, such as a mechanical spring. According to an example, the elastic member may exert the elastic force to push the driver coupler 510 toward a releasing or disengaging direction of the driver coupler 510 that is away from the power driver 410. For example, the elastic member 560 may provide an elastic force to move the driver coupler 510 to be disengaged or decoupled from the power driver when the power transfer member 530 moves the driver coupler 510 toward the disengaging direction, or when the first power transfer part 531 is detached from the second power transfer part 532.

According to an example, a cartridge 2 may include a rotatable drum 10 and a cartridge cover 40 movable to a cover position to cover at least a portion of the rotatable drum 10 and an uncover position to uncover at least the portion of the rotatable drum 10. According to an example, the power transfer part 531 may move in the second direction to transfer the power from the cartridge cover 40 moving from the cover position to the uncover position.

According to an example, FIGS. 7A-7G illustrate a coupling/decoupling process of the driver coupler 510 to the power driver.

Figure 7A:
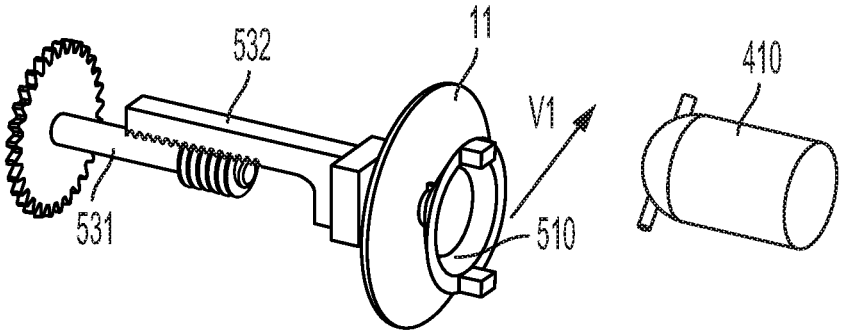
FIGS. 7A-7G illustrate coupling/decoupling processes of the driver coupler to the power driver according to an example.

Referring FIG. 7A, before the cartridge 2 is inserted into the cartridge receiving part 20 of the printing apparatus 1000, the driver coupler 510 is retracted from a first position to be engaged with the power driver 410 and, for example, may be at a second position or may be at a position further retracted from the second position. According to an example, as the cartridge 2 is being inserted into the cartridge receiving part 20, the power transfer member 530 may not move the driver coupler 510. According to an example, as the cartridge 2 is being inserted into the cartridge receiving part 20, the power transfer member 530 may move the driver coupler 510. For example, when the cartridge 2 is inserted into the cartridge receiving part 20, the driver coupler 510 is aligned with the power driver 410, and the power driver is retracted from a first position to be engaged with the power driver 410 and positioned to be disengaged with the power driver 410, for example, at the second position, and a distance or a gap between the power driver 410 and the driver coupler 510 sufficiently large enough for the cartridge 2 to not interfere with the power driver 410.

Again, according to an example, as the cartridge 2 is being inserted into the cartridge receiving part 20, the power transfer member 530 may move the driver coupler 510. According to an example, the power transfer member 530 also may not move the driver coupler 510, such that the driver coupler 510 may move to engage with the power driver 410 after the cartridge 2 is inserted into the cartridge receiving part 20.

Figure 7B:
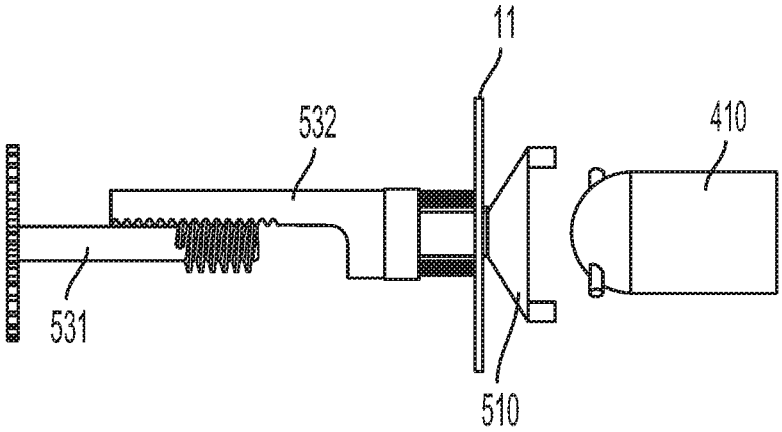
Figure 7C:
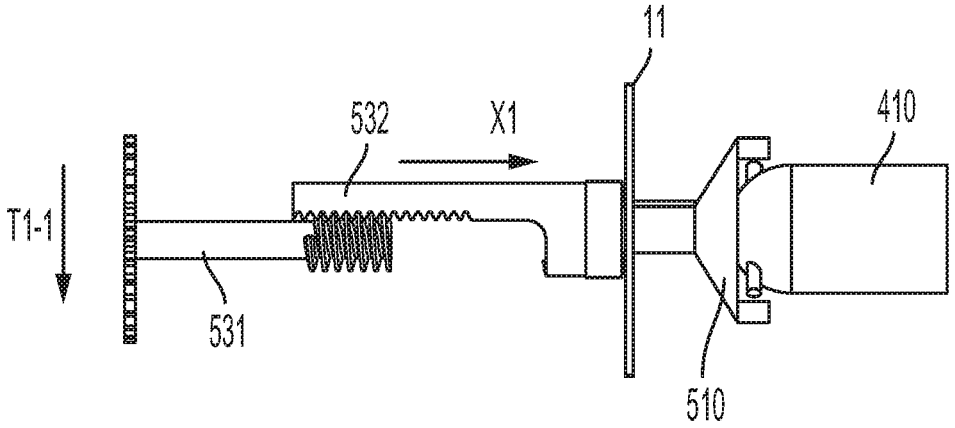

According to an example, referring FIGS. 7A-7C, as the cartridge 2 is inserted along the vector V1, the driver coupling mechanism 50, such as a worm gear assembly as shown in FIGS. 7A-7G, may move the driver coupler 510 in a first direction to a first position to be engaged with the power driver 410, for example, where the driver coupler 510 is being coupled to or contact the power driver 410. According to an example, the cartridge cover 40 moving from the position as shown in FIG. 3A to the position as shown in FIG. 3B may transfer torque T1-1 to the worm gear assembly 530. Referring FIG. 7C, the worm gear assembly 530 may move the driver coupler 510 to the first position by actuating the rack distance X1 and eliminating the Gap shown in FIG. 7B.

Figure 7D:
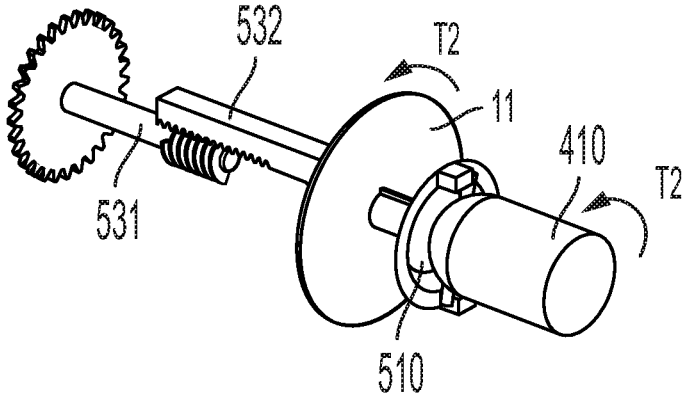

Referring FIG. 7D, with the Gap shown in FIG. 7B closed, the power driver 410 engaged with the driver coupler 510 drive the cartridge 2, for example by transferring power in a form of rotation or rotation power T2. For example, the power driver 410 engaged with the driver coupler 510 may rotate in a direction indicated by the arrows in FIG. 7D, and the cartridge power interface 11 or a cartridge drive interface 11 may receive the rotation power T2 to be rotated to driver the cartridge 2. According to an example, the first power transfer part 531 and the second power transfer part 532 may not be driven by the power being received and transferred by the cartridge power interface 11. According to an example, other forms of power transfer other than a form of rotation may be implemented. For example, the power can be delivered in other mechanical forms such as crank-based structure, or electrical form of power may be transferred to drive the cartridge 2.

According to an example, when the cartridge 2 is removed, as the cartridge 2 is being removed or pulled out of the cartridge receiving part 20, the power transfer member 530 may move the driver coupler 510, for example, to be disengaged from the power driver 410. According to an example, before the cartridge 2 is being removed or pulled out of the cartridge receiving part 20, the power transfer member 530 may move the driver coupler 510 to be disengaged from the power driver 410.

Figure 7E:
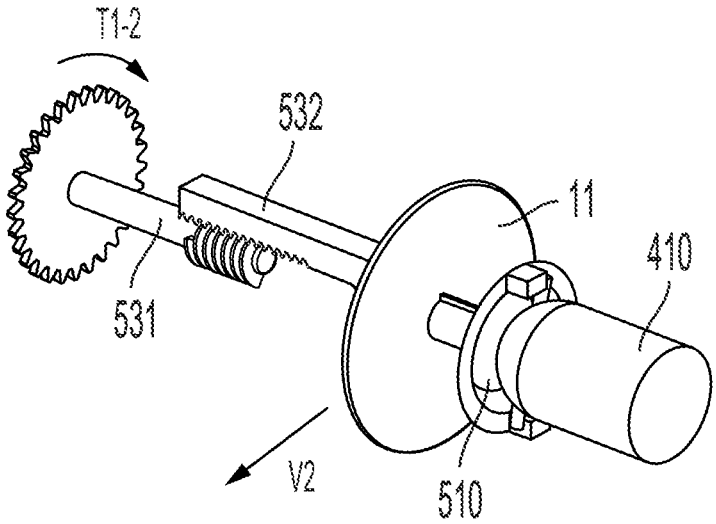
Figure 7F:
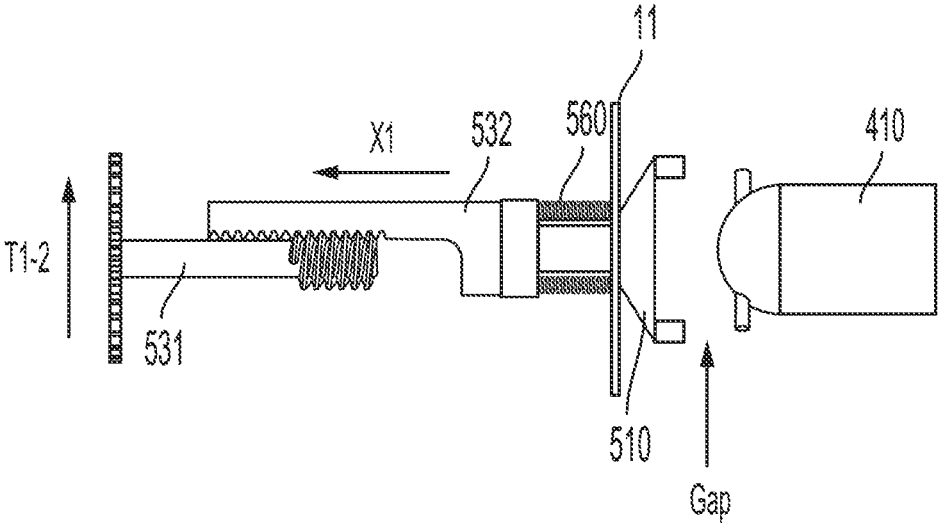
Figure 7G:
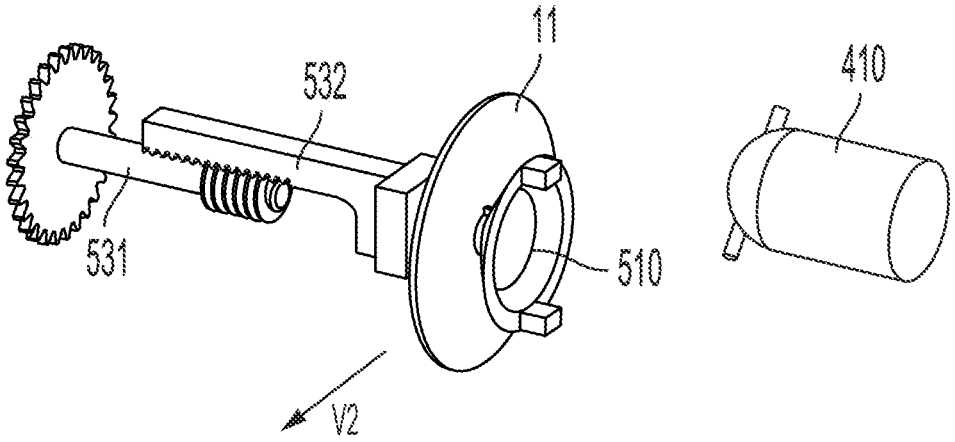

According to an example, referring FIGS. 7E, 7F and 7G, as the cartridge 2 is decoupled and removed along the vector V2, the worm gear assembly 530 may move the driver coupler 510 in a disengaging direction from the first position to be disengaged with the power driver 410, for example, where the driver coupler 510 is being decoupled from the power driver 410. According to an example, the cartridge cover 40 moving from the position as shown in FIG. 3B to the position as shown in FIG. 3A may transfer the torque T1-2 in a reverse direction to torque T1-1 to the worm gear assembly 530. Referring FIGS. 7E, 7F, and 7G, the worm gear assembly 530 may move the driver coupler 510 away from the first position by actuating the rack distance X1 backward and recreating the Gap shown in FIG. 7F, uncoupling the driver coupler 510 from the power driver 410. For example, as the cartridge 2 is removed along vector V2, torque T1-2 is applied to the worm gear assembly 530 from a movement of the cartridge cover 40.

According to an example, an elastic force from the elastic member 560 may further aid the decoupling process by reintroducing the gap as shown in FIG. 7F.

Figure 8A:
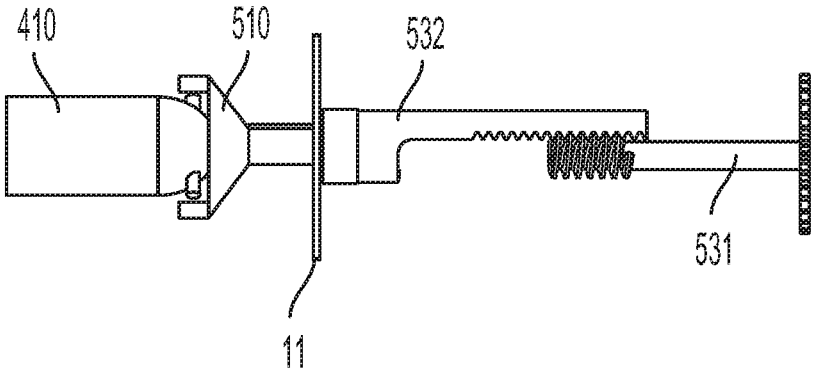
FIGS. 8A and 8B illustrate a decoupling process by detaching the first power transfer part 531 from the second transfer part according to an example.
Figure 8B:
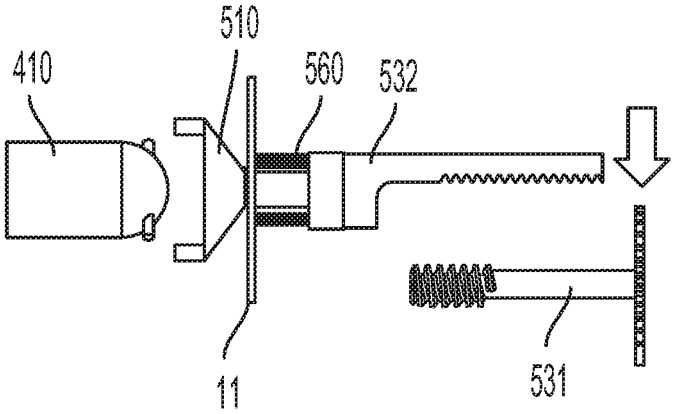

According to an example, when the driver coupler 510 has moved to the engaging position, the driver coupler 510 may move away from the engaging position, without receiving any power transferred through the power transfer member 530. For example, FIGS. 8A and 8B illustrate a decoupling process by detaching the first power transfer part 531 from the second transfer part. For example, when the door 3 of the printing apparatus, such as the door shown on FIGS. 1A and 1B, is opened, a lever or a mechanical structure connected to the door may be released or moved or manually moved and may push the first power transfer part 531 away from the second power transfer part 532, such that driver coupler 510 is released from the first power transfer part and moved to be separated from and/or disengage from the power driver 410. According to an example, an elastic member may be provided to provide an elastic force to move the driver coupler 510 away from the engaging position. For example, referring FIGS. 8A and 8B, the elastic force by the elastic member 560 may push the driver coupling mechanism 50 away from the engine drive mechanism.

According to an example, a cartridge 2 couplable to a printing apparatus 1000 may include a rotatable drum 10, a driver coupler 510 movable to a first position where the driver coupler 510 is engaged with a power driver of the printing apparatus to drive the cartridge 2 and a second position where the driver coupler 510 is disengaged from the power driver 410. According to an example, the rotatable drum 10 may be movable along with the driver coupler 510 and movable to a first drum position as the driver coupler 510 moves to the first position and a second drum position as the driver coupler 510 moves to the second position.

Figure 9:
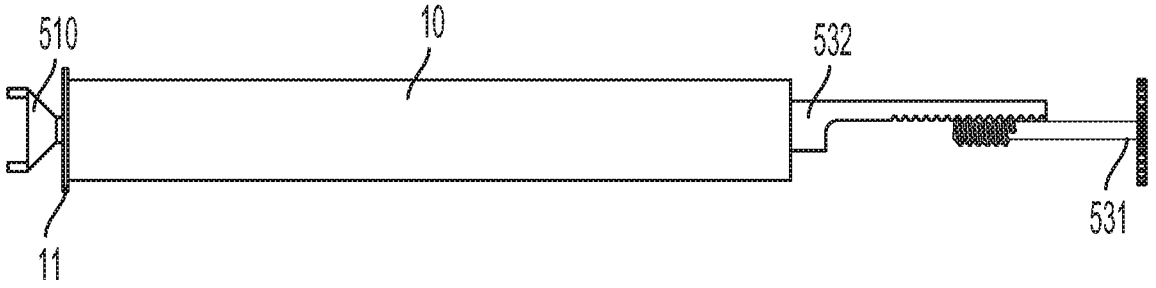
FIG. 9 illustrates a cartridge including a driver coupling mechanism, where the drum is coupled to the driver coupling mechanism to move along with the driver coupler, according to an example.
Figure 10:
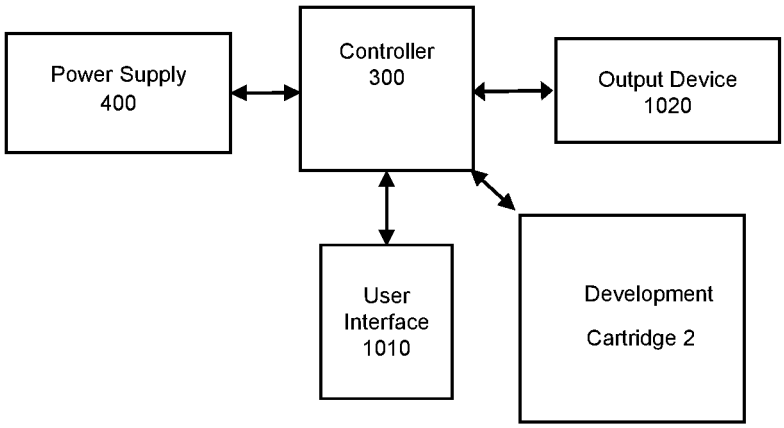
FIG. 10 indicates the flow diagram of a control system regarding a cartridge couplable to a printing device, according to an example.

According to an example, FIG. 9 illustrates a cartridge 2 including a driver coupling mechanism 50, where the drum 10 is coupled to the driver coupling mechanism 50 to move along with the driver coupler 510. According to an example, the rotatable drum 10 may move along with the driver coupler 510 as the driver coupler 510 moves to the engaging position. According to an example, a cartridge 2 couplable to a printing apparatus 1000 may include a rotatable drum, and a driver coupler 510 movable to a first position where the driver coupler 510 is engaged with a power driver of the printing apparatus to drive the cartridge and a second position where the driver coupler 510 is disengaged from the power driver. In this case, the rotatable drum may movable along with the driver coupler 510 and movable to a first drum position as the driver coupler 510 moves to the first position and a second drum position as the driver coupler 510 moves to the second position. A power transfer member 530 may be provided to transfer power to move the driver coupler 510 from the second position to the first position. According to an example, the cartridge power interface 11 or the cartridge drive interface 11 may be coupled to or connected to the drum 10, to enable the drum to be movable along with the cartridge power interface 11 or the cartridge drive interface 11, or the driver coupler 510.

According to an example, the printing apparatus 1000 may be controlled to output information regarding the driver coupler 510 being engaged with the power driver 410 or disengaged with the power driver 410. According to an example, the printing apparatus 1000 may include a controller 300 to control to output information regarding the driver coupler 510 being engaged with the power driver 410 or disengaged with the power driver 410. For example, a message may be presented on a screen of the user interface 1010 regarding the status of alignment or separation of the driver coupler 510 and the power driver 410, or based on the position or coupling status of the cartridge 2 to the printing apparatus 1000, or a light indication may be provided. Further the output may be in any form of feedback presented through the user interface 1010, or a sound generated by the user interface 1010 or the output device 1020 including a speaker, which may also provide a user information regarding the coupling status or the cartridge coupling status of the separation of the cartridge 2 from the cartridge receiving part 20. The user interface 1010 and output device 1020 may be combined as a single device where the user interface 1010 includes the output device 1020 or vice versa.

While various examples have been described with reference to the drawings, it will be understood that various changes in form and details may be made therein without departing from the spirit and scope as defined by the following claims.

What is claimed is:

1. A cartridge couplable to a printing apparatus comprising:

a driver coupler movable in a first direction toward an engaging position to engage with a power driver of the printing apparatus to drive the cartridge;

a power transfer member including a power transfer part to transfer power moving the driver coupler in the first direction toward the engaging position, as the power transfer part moves in a second direction different from the first direction;

a rotatable drum; and a cartridge cover movable to:

a cover position to cover at least a portion of the rotatable drum, and an uncover position to uncover at least the portion of the rotatable drum, wherein the power transfer part is to move in the second direction to transfer the power from the cartridge cover moving from the cover position to the uncover position.

2. The cartridge according to claim 1, wherein the power transfer part is to rotate in the second direction by receiving torque.

3. The cartridge according to claim 2, wherein the power transfer part is a worm gear to rotate in the second direction, and the power transfer member includes a rack to be moved in the first direction by a rotation of the worm gear.

4. The cartridge according to claim 1, wherein the rotatable drum is to move along with the driver coupler as the driver coupler moves to the engaging position.

5. The cartridge according to claim 1, wherein, when the driver coupler has moved to the engaging position, the driver coupler is to move away from the engaging position, without receiving any power transferred through the power transfer part.

6. The cartridge according to claim 5, further comprising an elastic member to provide an elastic force to move the driver coupler away from the engaging position.

7. A cartridge couplable to a printing apparatus comprising:

a rotatable drum;

a driver coupler movable to:

a first position where the driver coupler is engaged with a power driver of the printing apparatus to drive the cartridge, and a second position where the driver coupler is disengaged from the power driver;

a power transfer member including a power transfer part to transfer power moving the driver coupler in a first direction toward the first position; and a cartridge cover movable to:

a cover position to cover at least a portion of the rotatable drum, and an uncover position to uncover at least the portion of the rotatable drum, wherein the power transfer part is to move in a second direction to transfer the power from the cartridge cover moving from the cover position to the uncover position, and wherein the rotatable drum is movable along with the driver coupler and movable to:

a first drum position as the driver coupler moves to the first position, and a second drum position as the driver coupler moves to the second position.

8. The cartridge according to claim 7, wherein the power transfer member is to transfer the power to move the driver coupler from the second position to the first position, as the power transfer part moves in the second direction different from the first direction.

9. The cartridge according to claim 8, wherein the power transfer member includes:

a worm gear to be rotated by the power, and a gear rack to be moved by a rotation of the worm gear.

10. The cartridge according to claim 8, wherein, when the driver coupler has moved to the first position by the power, the driver coupler is movable from the first position to a third position different from the first position and the second position, without receiving any power transferred through the power transfer member.

11. The cartridge according to claim 10, further comprising an elastic member to provide an elastic force to move the driver coupler from the first position to the third position.

12. A printing apparatus comprising:

a power driver to drive a cartridge when the cartridge is connected with the power driver;

a cartridge receiving part to which the cartridge is detachably couplable to the printing apparatus to be connected with the power driver, the cartridge including:

a driver coupler movable in a first direction toward an engaging position to engage with the power driver, to connect the cartridge with the power driver; and a power transfer member including a power transfer part to transfer power moving the driver coupler in the first direction toward the engaging position, as the power transfer part moves in a second direction different from the first direction;

a rotatable drum; and a cartridge cover movable to:

a cover position to cover at least a portion of the rotatable drum, and an uncover position to uncover at least the portion of the rotatable drum, wherein the power transfer part is to move in the second direction to transfer the power from the cartridge cover moving from the cover position to the uncover position.

13. The printing apparatus according to claim 12, wherein the rotatable drum is to move along with the driver coupler as the driver coupler moves to the engaging position.

* * * * *